US007544079B2

(12) United States Patent
Chen et al.

(10) Patent No.: US 7,544,079 B2
(45) Date of Patent: Jun. 9, 2009

(54) ELECTRONIC APPARATUS

(75) Inventors: Chiu-Chia Chen, Taipei (TW); Wen-Cheng Tsai, Taipei (TW)

(73) Assignee: Asustek Computer Inc., Taipei (TW)

( * ) Notice: Subject to any disclaimer, the term of this patent is extended or adjusted under 35 U.S.C. 154(b) by 6 days.

(21) Appl. No.: 11/783,372

(22) Filed: Apr. 9, 2007

(65) Prior Publication Data

US 2007/0246339 A1 Oct. 25, 2007

(30) Foreign Application Priority Data

Apr. 25, 2006 (TW) ..... 95114732 A

(51) Int. Cl.
*H01H 3/08* (2006.01)

(52) U.S. Cl. ..... 439/336

(58) Field of Classification Search ..... None
See application file for complete search history.

(56) References Cited

U.S. PATENT DOCUMENTS 2,336,425 A * 12/1943 Shenton ..... 200/330
3,632,940 A * 1/1972 Burns ..... 200/330
4,381,437 A * 4/1983 Geremia ..... 200/574
4,520,242 A * 5/1985 Kopsho, Jr. ..... 200/332.1

FOREIGN PATENT DOCUMENTS

JP 63-48141 * 2/1988 ..... 200/302.3

* cited by examiner

*Primary Examiner*—Edwin A. Leon
(74) *Attorney, Agent, or Firm*—Birch, Stewart, Kolasch & Birch, LLP

(57) ABSTRACT

An electronic apparatus includes a housing, a first switch, a second switch, and a knob. In this case, the first switch and the second switch are disposed on an inner surface of the housing. The knob is pivoted on the housing, and disposed between the first switch and the second switch. When the knob rotates in a first direction, the knob touches the first switch. When the knob rotates in a second direction, the knob touches the second switch.

8 Claims, 10 Drawing Sheets

2

ELECTRONIC APPARATUS

BACKGROUND OF THE INVENTION

1. Field of Invention

The invention relates to an electronic apparatus and, in particular, to an electronic apparatus using a knob to control its switch.

2. Related Art

The electronic apparatus shown in FIG. 1 is a usual computer host 1. It has a housing 10 which accommodates hard disk drives (HDD), floppy disk drives (FDD), optical disk drives, etc (not shown in the drawing). The housing 10 has two openings 11, 12 installed with a first button 13 and a second button 14. A power switch (not shown) is disposed behind the first button 13 for starting the computer host 1. A restart button (not shown) is disposed behind the second button 14 for restarting the computer host 1. Therefore, the user can start or restart the computer host 1 by pressing the first button 13 or the second button 14.

It is an objective of the invention to provide a new mechanism to touch the first and second switches, instead of pressing the first button 13 or the second button 14 as in the prior art.

SUMMARY OF THE INVENTION

In view of the foregoing, the invention is to provide an electronic apparatus that uses a knob to touch a first switch or a second switch.

As mentioned above, an electronic apparatus of the invention includes a housing, a first switch, a second switch, and a knob. The first switch and the second switch are disposed on an inner surface of the housing. The knob is pivoted on the housing, and disposed between the first switch and the second switch. When the knob rotates in a first direction, the knob touches the first switch. When the knob rotates in a second direction, the knob touches the second switch.

As described above, the electronic apparatus of the invention has a special knob structure so that the user can activate the first or second switch by rotating it. In comparison with the prior, the disclosed mechanism is much more convenient.

BRIEF DESCRIPTION OF THE DRAWINGS

The invention will become more fully understood from the detailed description given herein below illustration only, and thus is not limitative of the present invention, and wherein.

DETAILED DESCRIPTION OF THE INVENTION

The present invention will be apparent from the following detailed description, which proceeds with reference to the accompanying drawings, wherein the same references relate to the same elements.

For the convenience of explanation, the electronic apparatus is a computer in this specification. However, the implementation of the invention is not limited to this specific example.

Figure 1:
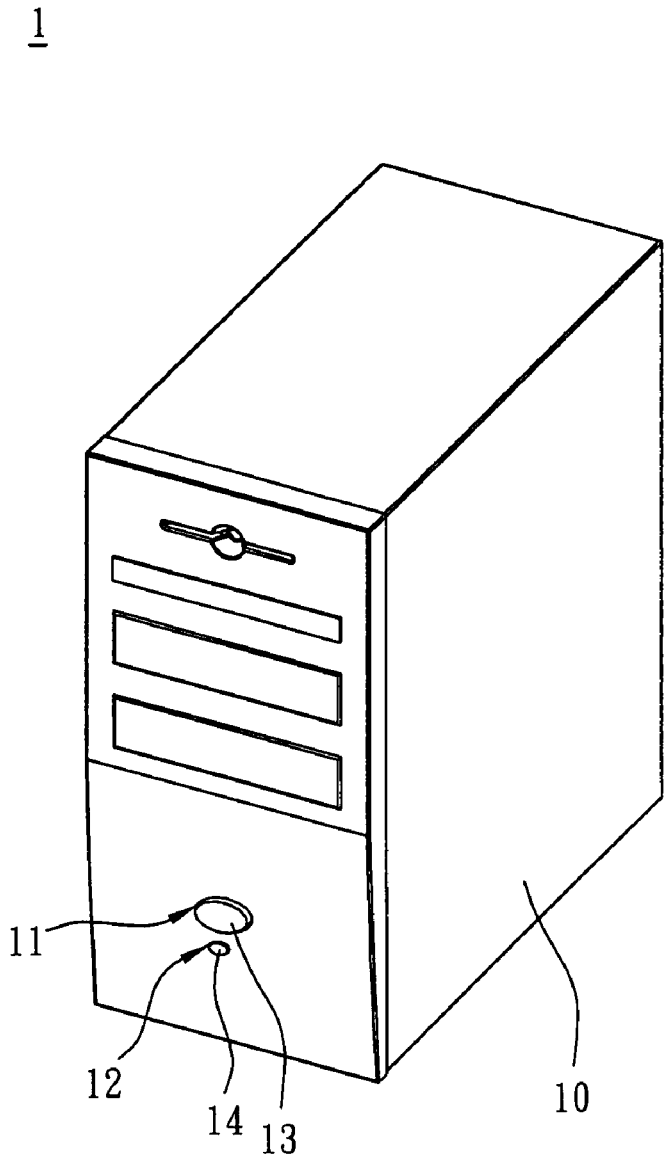
FIG. 1 PRIOR ART
FIG. 1 is a schematic view of a conventional computer.
Figure 2:
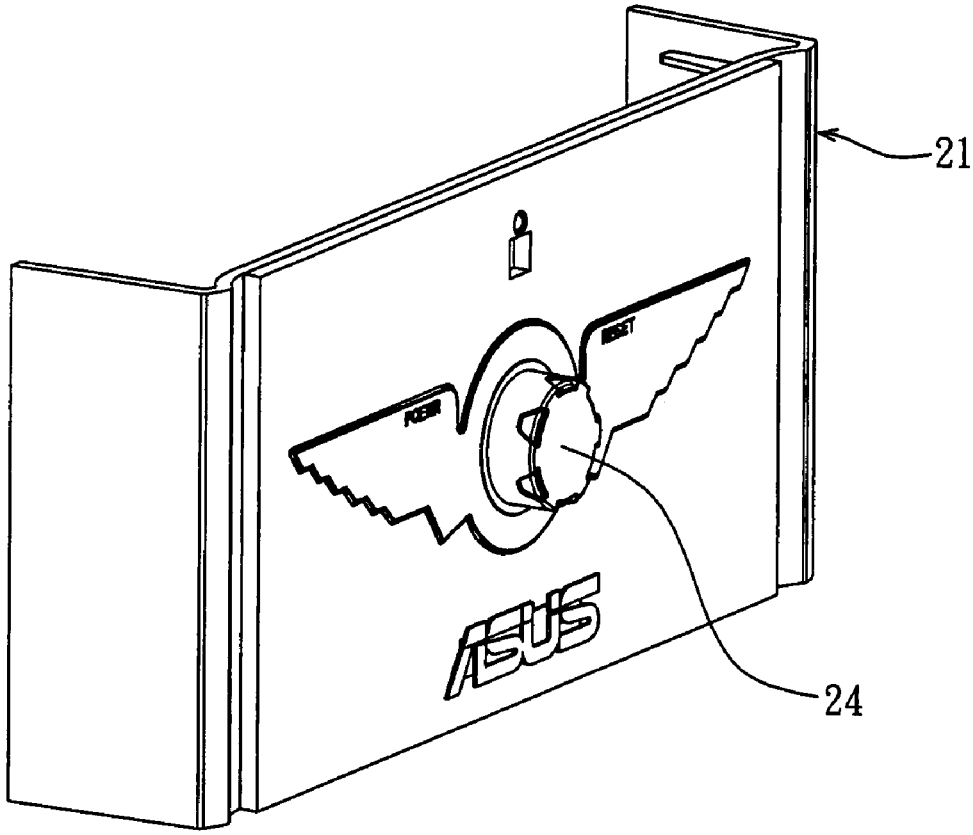
FIG. 2 is a schematic view showing the outside of the housing of the disclosed electronic apparatus.
Figure 3:
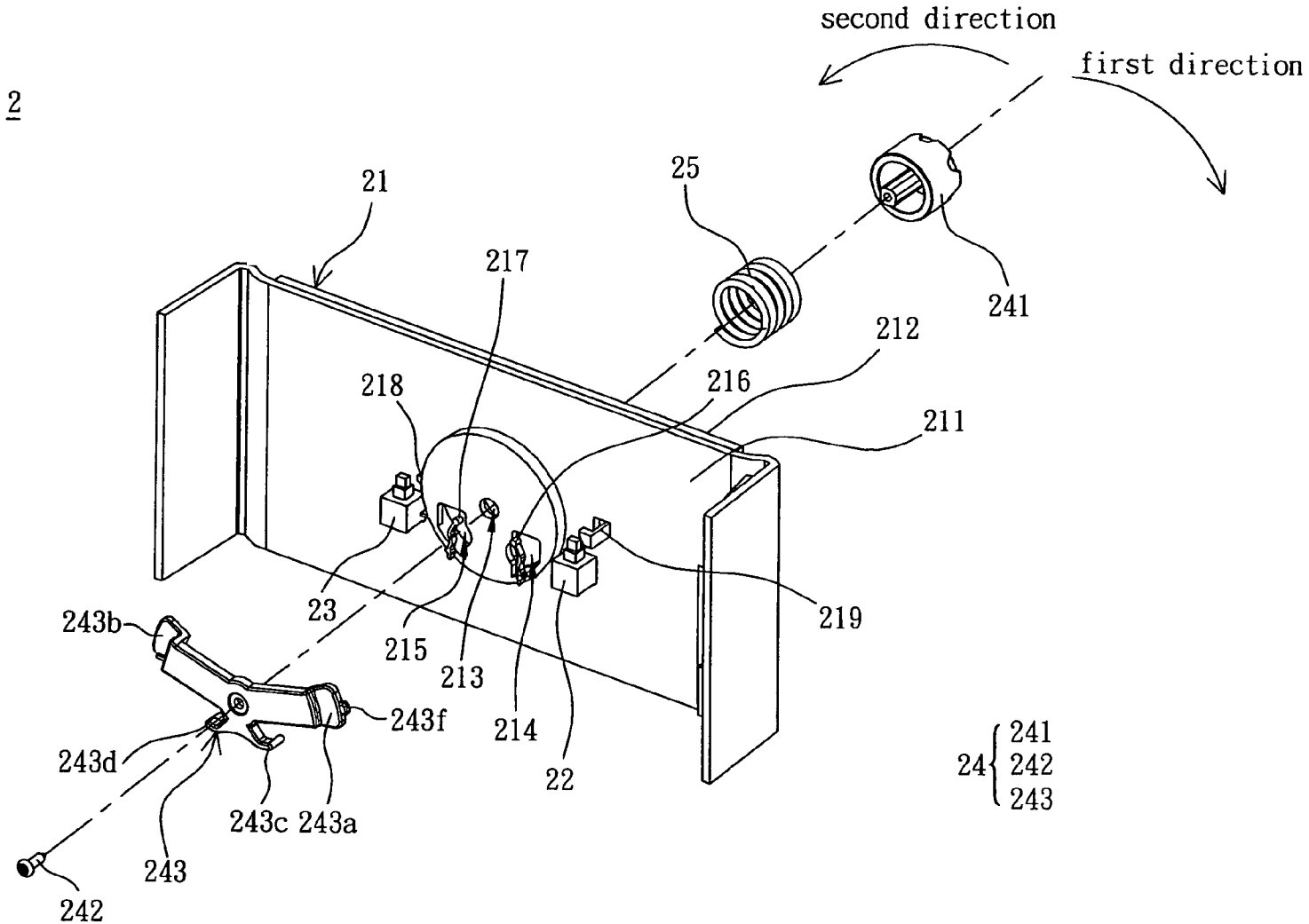
FIG. 3 is a schematic view showing the inside of the housing of the disclosed electronic apparatus.

With reference to FIGS. 2 and 3, the electronic apparatus 2 according to a preferred embodiment of the invention includes a housing 21, a first switch 22, a second switch 23, and a knob 24.

The housing 21 is the case of a computer. In this embodiment, the housing 21 has an inner surface 211 and an outer surface 212. The housing 21 further includes a first through hole 213, a second through hole 214, and a third through hole 215 penetrating through the inner surface 211 and the outer surface 212. The first through hole 213 is formed between the second through hole 214 and the third through hole 215.

Besides, the housing 21 also includes a first elastic part 216, a second elastic part 217, a first stopping block 218, and a second stopping block 219. The first elastic part 216 is disposed in the second through hole 214. The second elastic part 217 is disposed in the third through hole 215.

As shown in FIGS. 2 and 3, the first switch 22 and the second switch 23 are disposed on the inner surface 211 of the housing 21. In this embodiment, the first switch 22 is a power switch, and the second switch 23 is a restart switch. The first switch 22 is disposed adjacent to the second stopping block 219, and the second switch 23 is disposed adjacent to the first stopping block 218.

With further reference to FIG. 3, the knob 24 is pivoted on the housing 21. The first switch 22 and the second switch 23 are disposed on both sides of the knob 24. When the knob 24 rotates in a first direction (indicated by the right arrow in FIG. 3), it touches the first switch 22. When the knob 24 rotates in a second direction (indicated by the left arrow in FIG. 5), it touches the second switch 23.

As shown in FIG. 3, the knob 24 in this embodiment has an operating part 241, a connecting part 242, and a co-moving component 243. The operating part 241 is disposed on the outer surface 212 of the housing 21. The co-moving component 243 is located in the housing 21. The connecting part 242 goes through the first through hole 213 and connects the operating part 241 and the co-moving component 243. Furthermore, the knob 24 can have a locking component 244, which goes through the co-moving component 243 and connects the co-moving component 243 with the connecting part 242. Of course, the locking component 244 is not necessary. The connecting part 242 and the co-moving component 243 can be connected by thermal welding or gluing.

Figure 9:
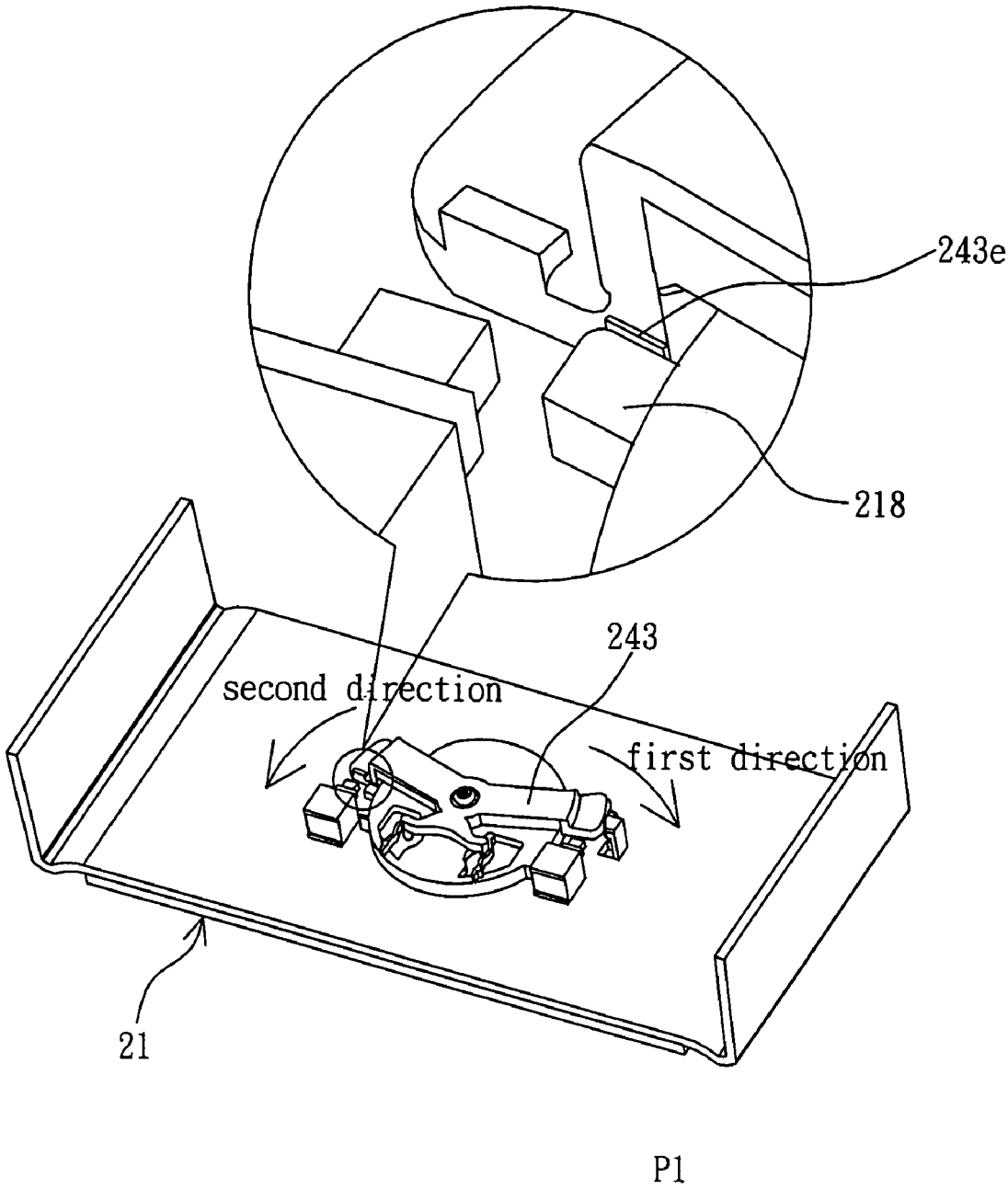
FIG. 9 shows that the fifth protruding part touches the first stopping block when the knob is in its first position.

As shown in FIGS. 3 and 9, the co-moving component 243 in this embodiment is an X-shaped plate with a first protruding part 243*a*, a second protruding part 243*b*, a third protruding part 243*c*, a fourth protruding part 243*d*, a fifth protruding part 243*e*, and a sixth protruding part 243*f*. The first protruding part 243*a* is disposed adjacent to the first switch 22. The second protruding part 243*b* is disposed adjacent to the second switch 23. The third protruding part 243*c* is disposed adjacent to the first elastic part 216. The fourth protruding part 243*d* is disposed adjacent to the second elastic part 217. The sixth protruding part 243*f* is disposed on the first protruding part 243*a*, and the fifth protruding part 243*e* is disposed on the second protruding part 243*b*.

Figure 4:
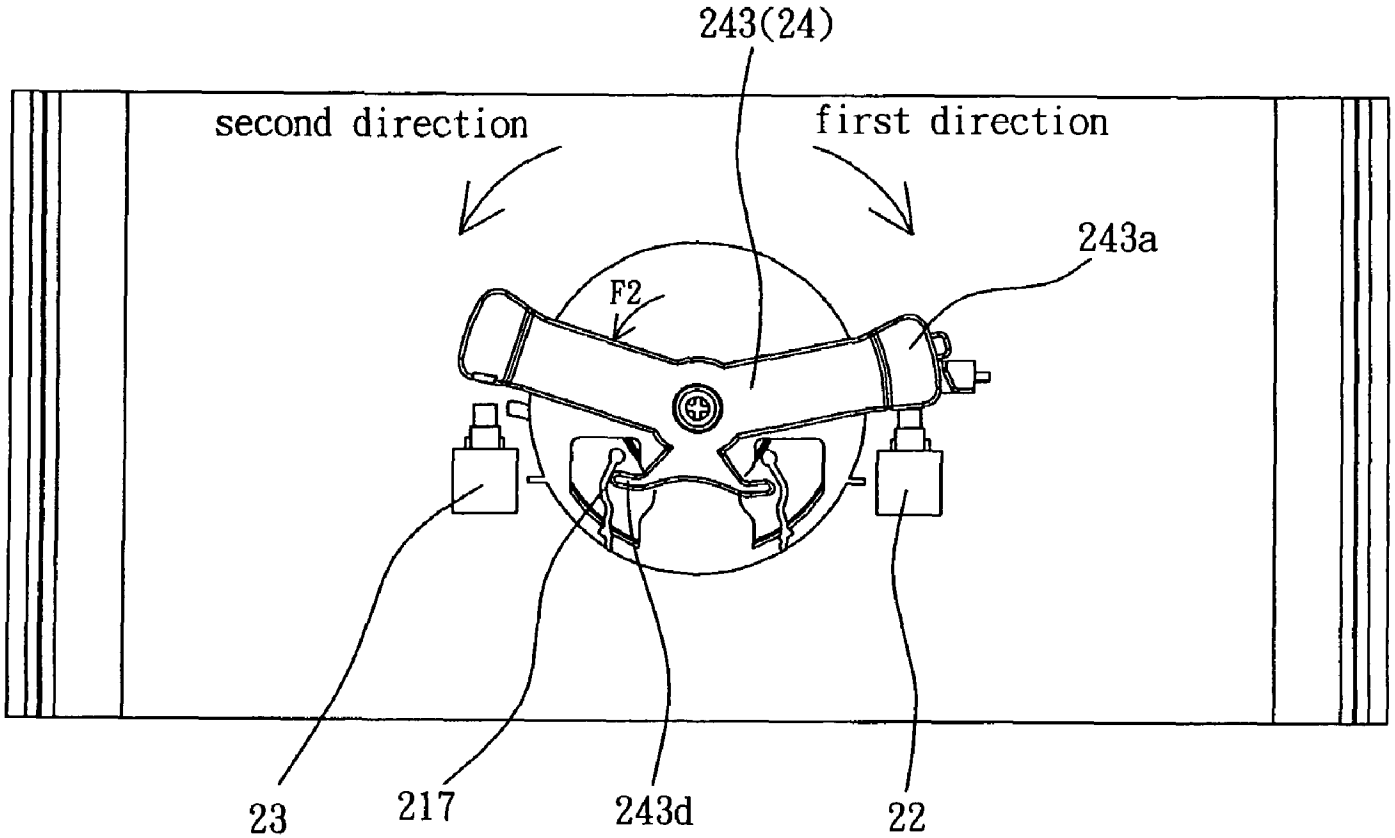
FIG. 4 shows the knob of the invention rotating in the first direction.

As illustrated by FIGS. 3 and 4, when the operating part 241 rotates in the first direction, the first protruding part 243*a* touches the first switch 22. The fourth protruding part 243*d* touches the second elastic part 217. In this case, the second elastic part 217 produces a second restoring force F2 in the second direction, bringing the co-moving component 243 back to its original position.

Figure 5:
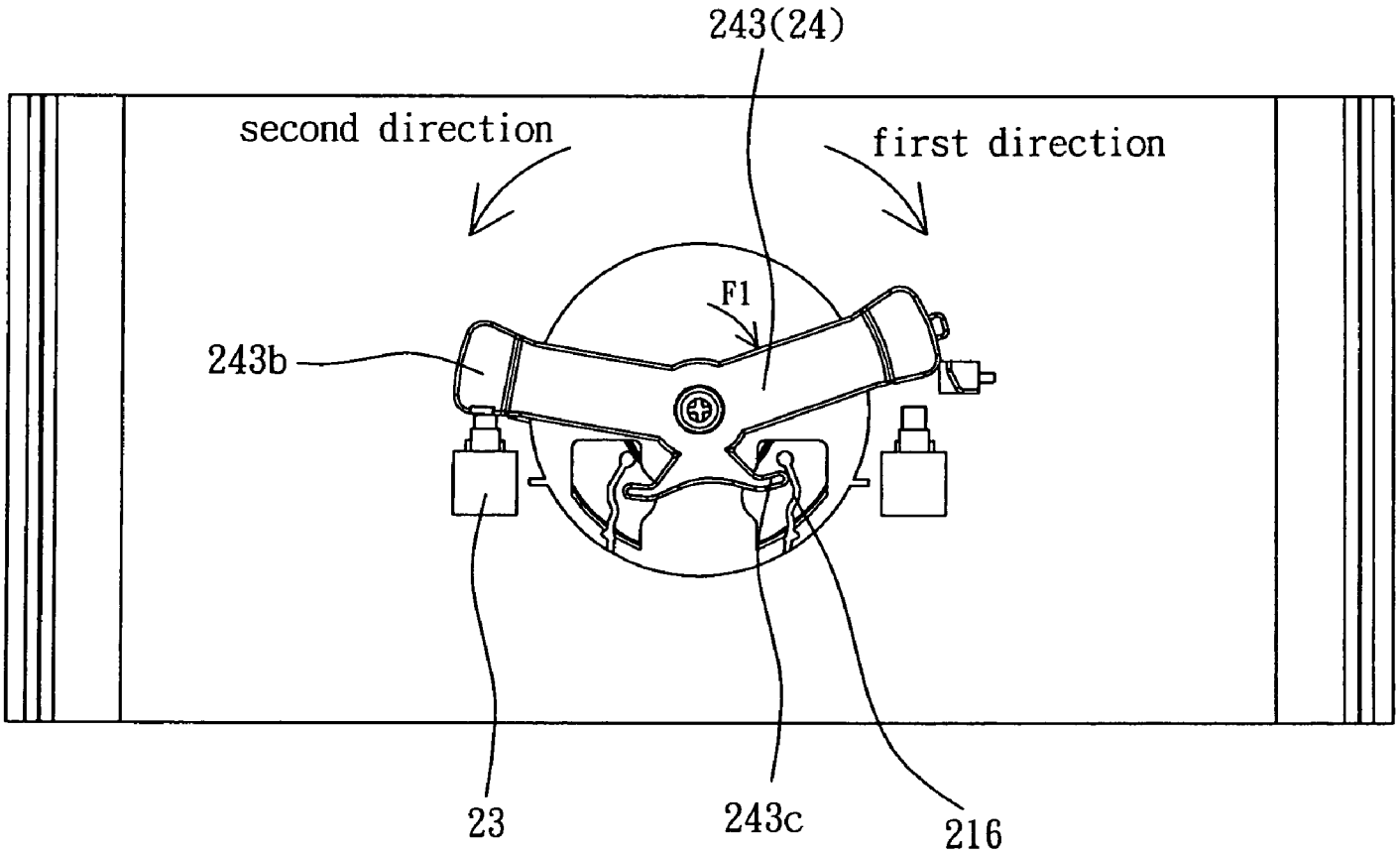
FIG. 5 shows the knob of the invention rotating in the second direction.

As illustrated in FIGS. 3 and 5, when the operating part 241 rotates in the second direction, the second protruding part 243*b* touches the second switch 23. The third protruding part 243*c* touches the first elastic part 216. In this case, the first elastic part 216 produces a first restoring force F1 in the first direction, bringing the co-moving component 243 back to its original position.

Additionally, as shown in FIG. 3, the electronic apparatus 2 in this embodiment further includes an elastic component 25 mounted on the connecting part 242.

Figure 6:
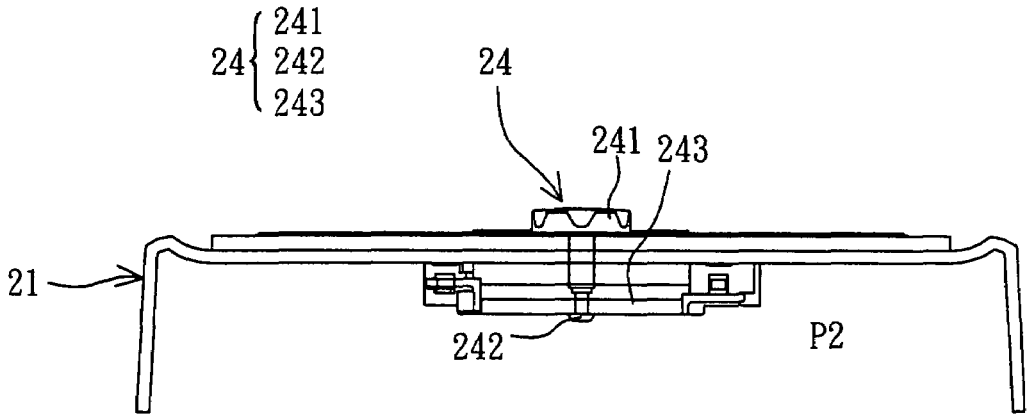
FIG. 6 shows the knob of the invention rotating in its second position.
Figure 7:
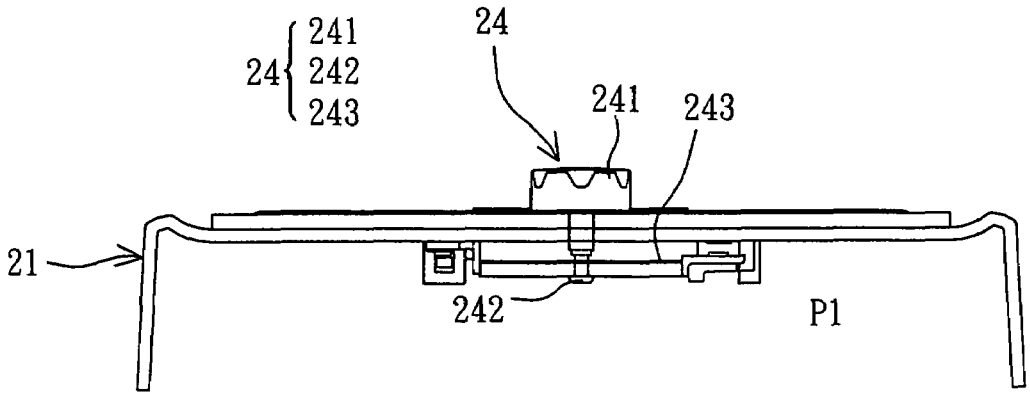
FIG. 7 shows the knob of the invention rotating in its first position.
Figure 8:
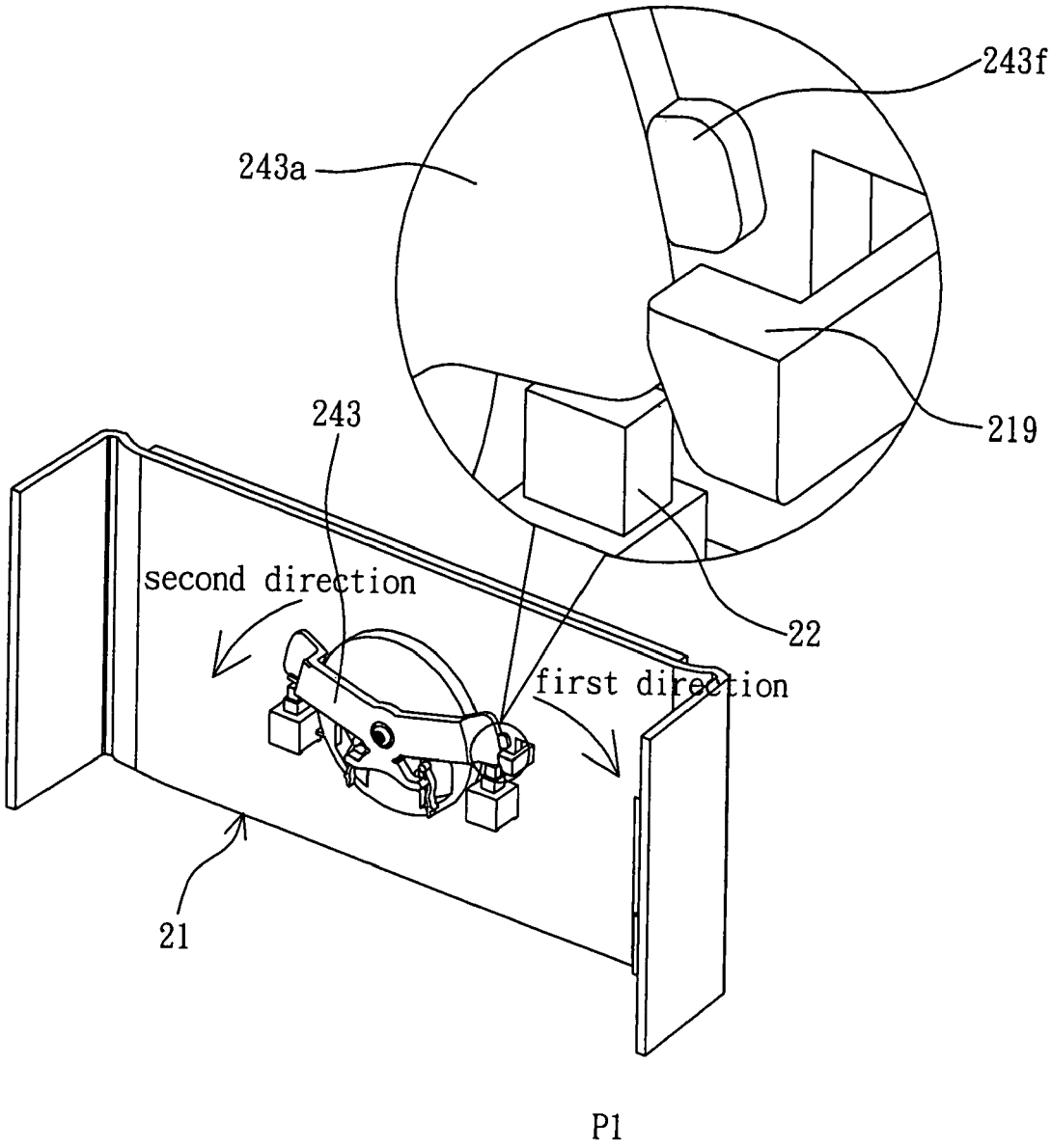
FIG. 8 shows that the first protruding part touches the first switch when the knob is in its first position.

As shown in FIG. 6, when an external force depresses the operating part 241, the knob 24 moves to a second position P2. As shown in FIG. 7, when the external force is removed, an elastic force of the elastic component 25 brings the knob 24 to a first position P1.

Please refer to FIGS. 7 and 9. When the knob 24 is in the first position P1 and to be rotated in the second direction, the fifth protruding part 243*e* touches the first stopping block 218. Therefore, the knob 24 is stopped by the first stopping block 218 from rotating in the second direction when it is at the first position P1. Instead, it can only rotate in the first direction.

Figure 10:
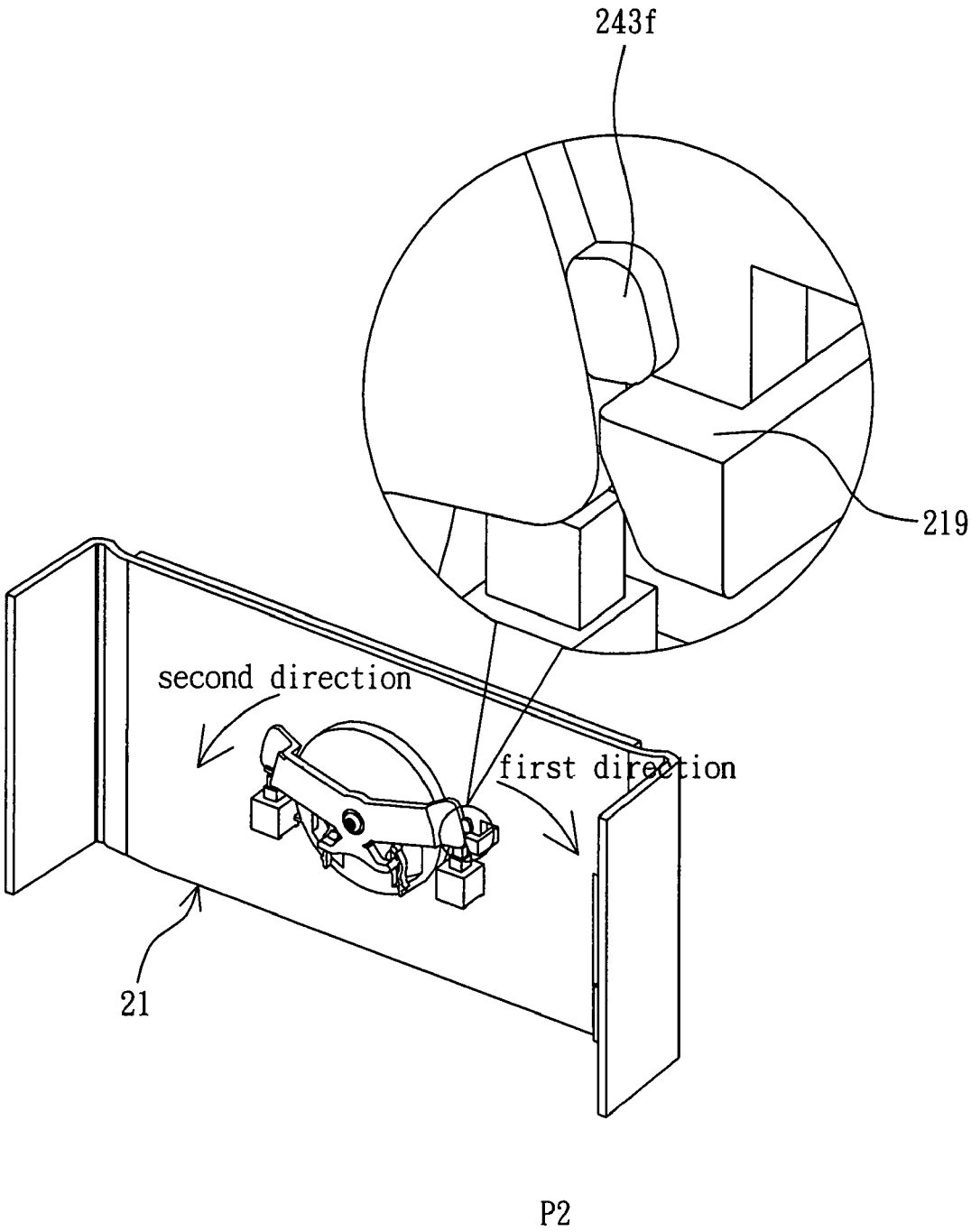
FIG. 10 shows that the sixth protruding part touches the second stopping block when the knob is in its second position.

Please refer to FIG. 6 and 10. When the knob 24 is in the second position P2 and to be rotated in the first direction, the sixth protruding part 243*f* touches the second stopping block 219. Therefore, the knob 24 is stopped by the second stopping block 219 from rotating in the second direction when it is at the second position P2. Instead, it can only rotate in the second direction.

In the following, we describe the actual operations of the electronic apparatus 2 in the embodiment.

With reference to FIGS. 7 and 9, when the user activates the first switch 22, the knob 24 is in the first position PI as it is under no external force (FIG. 7). Since the knob 24 (the fifth protruding part 243*e*) is restricted by the first stopping block 218, the user can only rotate the knob 24 in the first direction (FIG. 9). In this case, the first protruding part 243*a* touches the first switch 22 and thus activates it. As shown in FIG. 4, when the user releases the knob 24, the fourth protruding part 243*d* is in touch with the second elastic part 217 that provides a second restoring force F2 to rotate the knob 24 in the second direction back to its original position.

Figure 11:
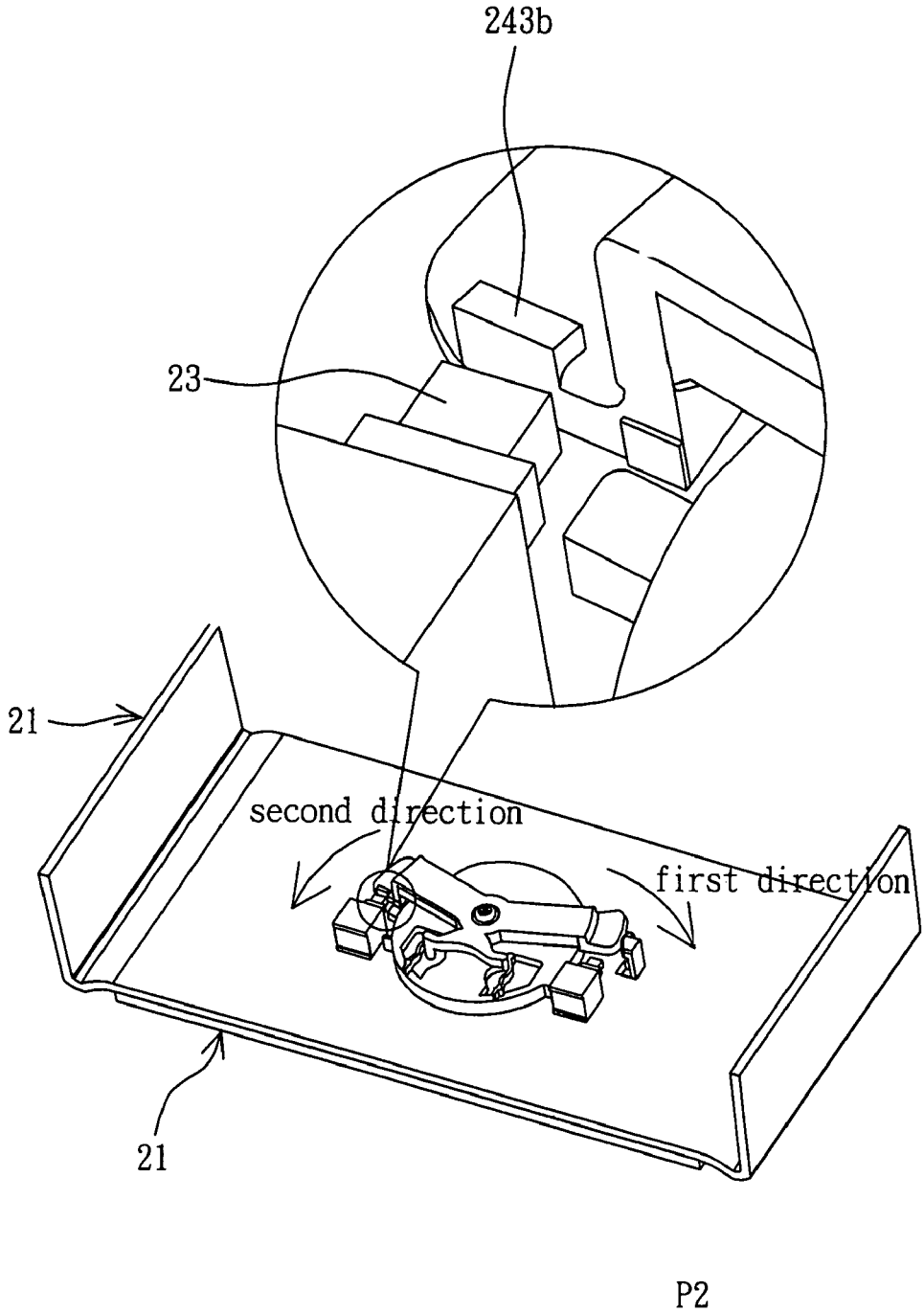
FIG. 11 shows that the second protruding part touches the second switch when the knob is in its second position.

As shown in FIGS. 5 and 6, when the user activates the second switch 23, the knob 24 is depressed and moved to its second position P2. With reference to FIG. 10, the knob 24 (the sixth protruding part 243*f*) is restricted by the second stopping block 219. The user can thus rotate the knob 24 only in the second direction (FIG. 11). The second protruding part 243*b* touches and activates the second switch 23. As illustrated in FIG. 5, once the user releases the knob 24, the third protruding part 243*c* is in touch with the first elastic part 216 that provides a first restoring force F1 to rotate the knob 24 in the first direction back to its original position.

As described above, the disclosed electronic apparatus has a special knob structure so that the user can activate the first or second switch by rotating it. In comparison with the prior, the disclosed mechanism is much more convenient.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. An electronic apparatus, comprising:

a housing having a first elastic part;

a first switch and a second switch, disposed on an inner surface of the housing; and a knob, which is pivoted on the housing and disposed between the first switch and the second switch, wherein the knob comprises a locking component, a connecting part and a co-moving component, wherein the knob touches the first switch when it rotates in a first direction, and when the knob rotates in a second direction and touches the second switch and the first elastic part, the first elastic part produces a second restoring force to rotate the knob in the first direction, and wherein the first direction and the second direction are parallel to an outer surface of the housing, wherein the locking component penetrates through the co-moving component and thus connects the co-moving component and the connecting part.

2. The electronic apparatus of claim 1 wherein the housing comprises a first through hole, the knob further comprises an operating part, the operating part is disposed on an outer surface of the housing, the connecting part connects the operating part and the co-moving component, the connecting part passes through the first through hole, and the co-moving component is located in the housing.

3. The electronic apparatus of claim 2, wherein the housing further includes a second elastic part, and the co-moving component includes:

a first protruding part, which is connected to the connecting part and disposed adjacent to the first switch;

a second protruding part, which is connected to the connecting part and disposed adjacent to the second switch;

a third protruding part, which is connected to the connecting part and disposed adjacent to the first elastic part, wherein the second protruding part touches the second switch and the third protruding part touches the first elastic part when the operating part rotates in the second direction, and the first elastic part produces a first restoring force to rotate the knob in the first direction; and a fourth protruding part, which is connected to the connecting part and disposed adjacent to the second elastic part, wherein the first protruding part touches the first switch and the fourth protruding part touches the second elastic part when the operating part rotates in the first direction, and the first elastic part produces a second restoring force to rotate the knob in the second direction.

4. The electronic apparatus of claim 3, wherein the housing comprises a second through hole and a third through hole, the first elastic part is disposed in the second through hole, the second elastic part is disposed in the third through hole, and the first through hole is formed between the second through hole and the third through hole.

5. The electronic apparatus of claim 3, wherein the co-moving component has an X shape.

6. The electronic apparatus of claim 3, further comprising an elastic component mounted on the connecting part, wherein the knob moves to a second position when an external force is imposed along the connecting part and to a first position when the external force is removed and an elastic force provided by the elastic component is imposed on the knob.

7. The electronic apparatus of claim 6, wherein the housing includes a first stopping block and a second stopping block, the co-moving component includes a fifth protruding part and a sixth protruding part, the fifth protruding part touches the first stopping block and is prevented from rotating in the second direction when the knob is in its first position, the sixth protruding part touches the second stopping block and is prevented from rotating in the first direction when the knob is in its second position.

8. The electronic apparatus of claim 7, wherein the sixth protruding part is formed on the first protruding part and the fifth protruding part is formed on the second protruding part.

* * * * *